US008526799B2

(12) United States Patent
Peet

(10) Patent No.: US 8,526,799 B2
(45) Date of Patent: Sep. 3, 2013

(54) AIR DEHUMIDIFIER SYSTEM FOR ENCLOSURES AND SAFES

(75) Inventor: Blair G. Peet, St. Maries, ID (US)

(73) Assignee: Peet Shoe Dryer, Inc., St. Maries, ID (US)

( * ) Notice: Subject to any disclaimer, the term of this patent is extended or adjusted under 35 U.S.C. 154(b) by 24 days.

(21) Appl. No.: 12/930,917

(22) Filed: Jan. 18, 2011

(65) Prior Publication Data

US 2012/0183283 A1 Jul. 19, 2012

(51) Int. Cl.
*F24D 5/10* (2006.01)

(52) U.S. Cl.
USPC ..... 392/350; 392/347; 392/367

(58) Field of Classification Search
None
See application file for complete search history.

(56) References Cited

U.S. PATENT DOCUMENTS 4,250,629 A * 2/1981 Lewis ..... 34/380
4,769,923 A * 9/1988 Chang ..... 34/582
5,369,892 A * 12/1994 Dhaemers ..... 34/275
5,478,379 A * 12/1995 Bevins ..... 96/119
6,718,650 B2 * 4/2004 Ross ..... 34/90
7,088,913 B1 * 8/2006 Verhoorn et al. ..... 392/367
7,158,716 B2 * 1/2007 Shapiro et al. ..... 392/365
7,190,887 B1 * 3/2007 Compton ..... 392/365
7,377,052 B2 * 5/2008 Maruca ..... 34/201
7,664,378 B2 * 2/2010 Gao ..... 392/360
7,664,379 B2 * 2/2010 Eisenhauer ..... 392/360
2006/0144226 A1 * 7/2006 Damrath et al. ..... 95/90
2007/0077042 A1 * 4/2007 Jayaram et al. ..... 392/385
2007/0144032 A1 * 6/2007 Maruca ..... 34/469
2008/0256826 A1 * 10/2008 Zarembinski ..... 34/562
2012/0222966 A1 * 9/2012 Silverman et al. ..... 205/626

* cited by examiner

*Primary Examiner* — Thor Campbell
(74) *Attorney, Agent, or Firm* — Wells St. John, PS

(57) ABSTRACT

An air dehumidifier for use in small enclosures such as gun and other types of safes is disclosed. The air dehumidifier provides a natural convection dehumidifier circulation system for use in enclosures that reduces natural convection airflow through a drying chamber and thereby dehumidifies and circulates air within the enclosure. Heated air released through the air flow apertures combine with air drawn in through the air intake apertures in the base, to provide air circulation and dehumidification within the safe interior. This invention also provides a drying chamber end cap which prevents articles within the enclosure from blocking the airflow out of the drying chamber.

2 Claims, 5 Drawing Sheets

AIR DEHUMIDIFIER SYSTEM FOR ENCLOSURES AND SAFES

CROSS REFERENCE TO RELATED APPLICATION

This application does not claim priority from any other application.

TECHNICAL FIELD

This invention pertains to an air dehumidifier for use in small enclosures such as gun and other types of safes. More particularly, this invention provides a natural convection dehumidifier circulation system for use in enclosures that produces natural convection airflow through a drying chamber and thereby dehumidifies and circulates air within the enclosure. This invention also provides a drying chamber end cap which prevents articles within the enclosure from blocking the airflow out of the drying chamber.

BACKGROUND OF THE INVENTION

It has long been a known issue that many enclosures such as safes, and more particularly, gun safes, retain an undesirable amount of humidity or moisture in the air within the enclosure, which may cause damage to guns and other articles within the enclosure.

Prior attempts to address the humidity issue have not been sufficiently successful, as some of these included merely adding a heat cylinder or other device to provide heat into the enclosure which does not necessarily remove the humidity as desired. It is also a potential issue to provide a heater or hot item that may become covered with articles that may cause overheating and become a hazard.

It is therefore an object of some embodiments of this invention to provide a dehumidifier solution or system which provides the desired dehumidification by natural convection and which prevents blockage of the drying chamber.

It is also an object of some embodiments of this invention to provide such a drying chamber that tends to induce natural convection there-through such that constant circulation occurs within the enclosure.

Other objects, features, and advantages of this invention will appear from the specification, claims, and accompanying drawings which form a part hereof. In carrying out the objects of this invention, it is to be understood that its essential features are susceptible to change in design and structural arrangement, with only one practical and preferred embodiment being illustrated in the accompanying drawings, as required.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Many of the fastening, connection, manufacturing and other means and components utilized in this invention are widely known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention and the practice of a specific application or embodiment of any element may already be widely known or used in the art or by persons skilled in the art or science; therefore, each will not be discussed in significant detail.

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

There are many aspects, applications and embodiments to this invention, especially in light of advantages the invention for enclosures of all kinds, but may provide and more fully describe some of those embodiments to safes and gun safes in particular.

Figure 1:
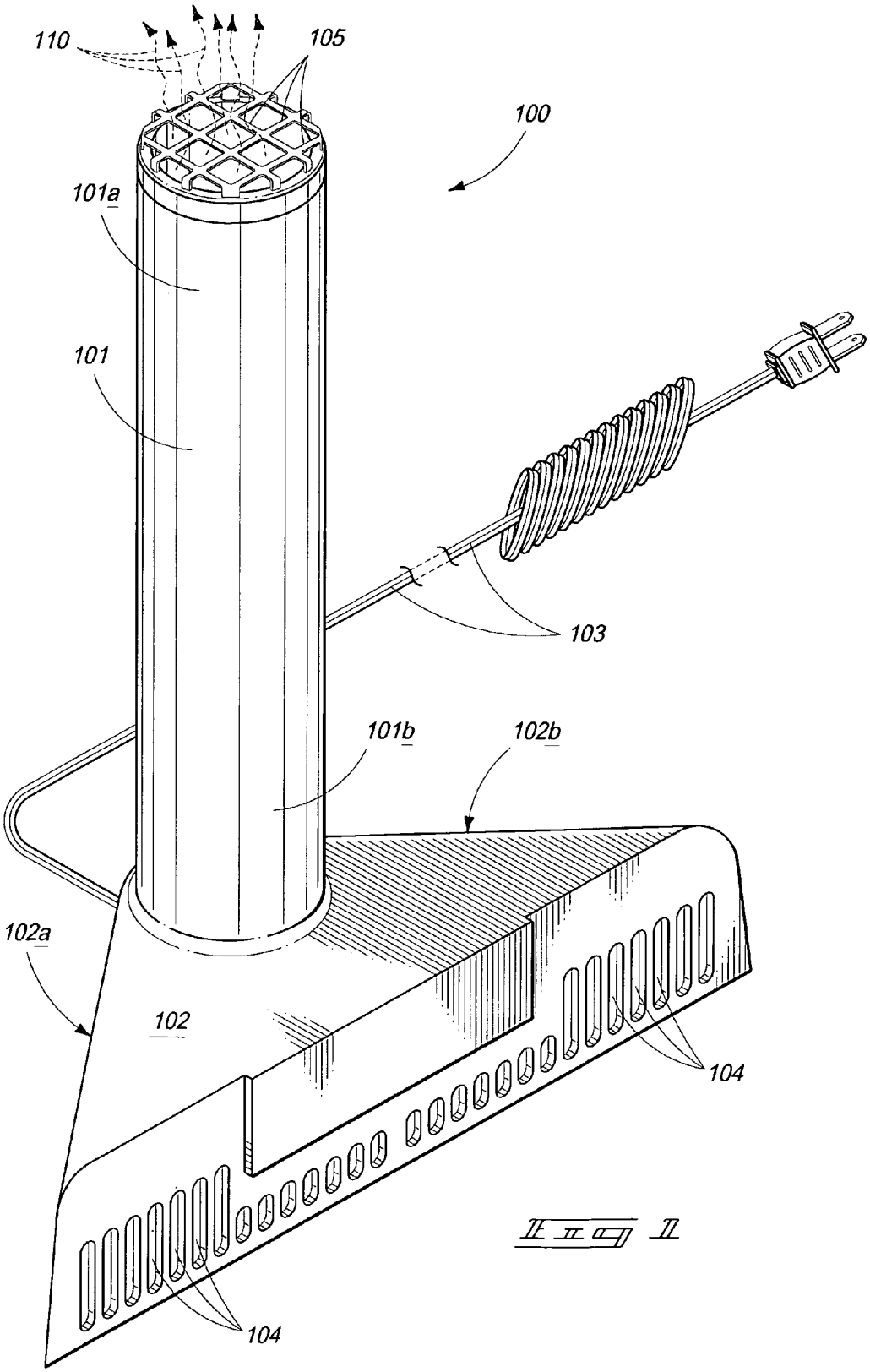
FIG. 1 is a perspective view of an example of one embodiment of this invention, which is also configured for placement within a corner area of enclosure.

FIG. 1 is a perspective view of an example of one embodiment of this invention 100, which is also configured for placement within a corner area of enclosure, and illustrates drying chamber 101 with upper end 101*a* and lower end 101*b*. It will be noted that in some embodiments of the invention the drying chamber will be tapered from its lower end 101*b* to its upper end 101*a*, which promotes further inducement and natural convection of air through the air chamber 101. FIG. 1 further illustrates base 102 with first side 102*a*, second side 102B configured approximately perpendicular to first side 102*a* to allow placement of the unit in or near a corner of the enclosure in which it will be placed. Power cord 103 is shown and would be operably connected to an electrical resistance heater within the invention to provide heat which induces the natural convection through the drying chamber. There would be a small power cord aperture in the enclosure or safe.

FIG. 1 further illustrates air intake apertures 104 on the front side of base 102, which is where cooler air is induced into the unit to pass by the electrical resistance heater, through the air chamber 101 and then flowing out the end cap 105. The exiting air from the end cap 105 is represented by arrows 110 and is warmer than the air which enters through intake apertures 104. An exemplary taper of the air chamber may include a base diameter of 44.5 millimeters and a top diameter of 42 millimeters, and those of ordinary skill in the art will appreciate the airflow effect of the tapering. An exemplary height of the air chamber may be 165.5 millimeters with the height from the base to the top of the end cap 105 being approximately 10.30 millimeters, although sloped or arcuate from the top to the size of the end cap 105.

It will be appreciated by those of ordinary skill in the art that the end cap 105 may be configured with aperture exits at different heights and in an arcuate shape to further prevent of potential garments or fabric covering the air chamber exit apertures within the end cap 105.

Figure 2:
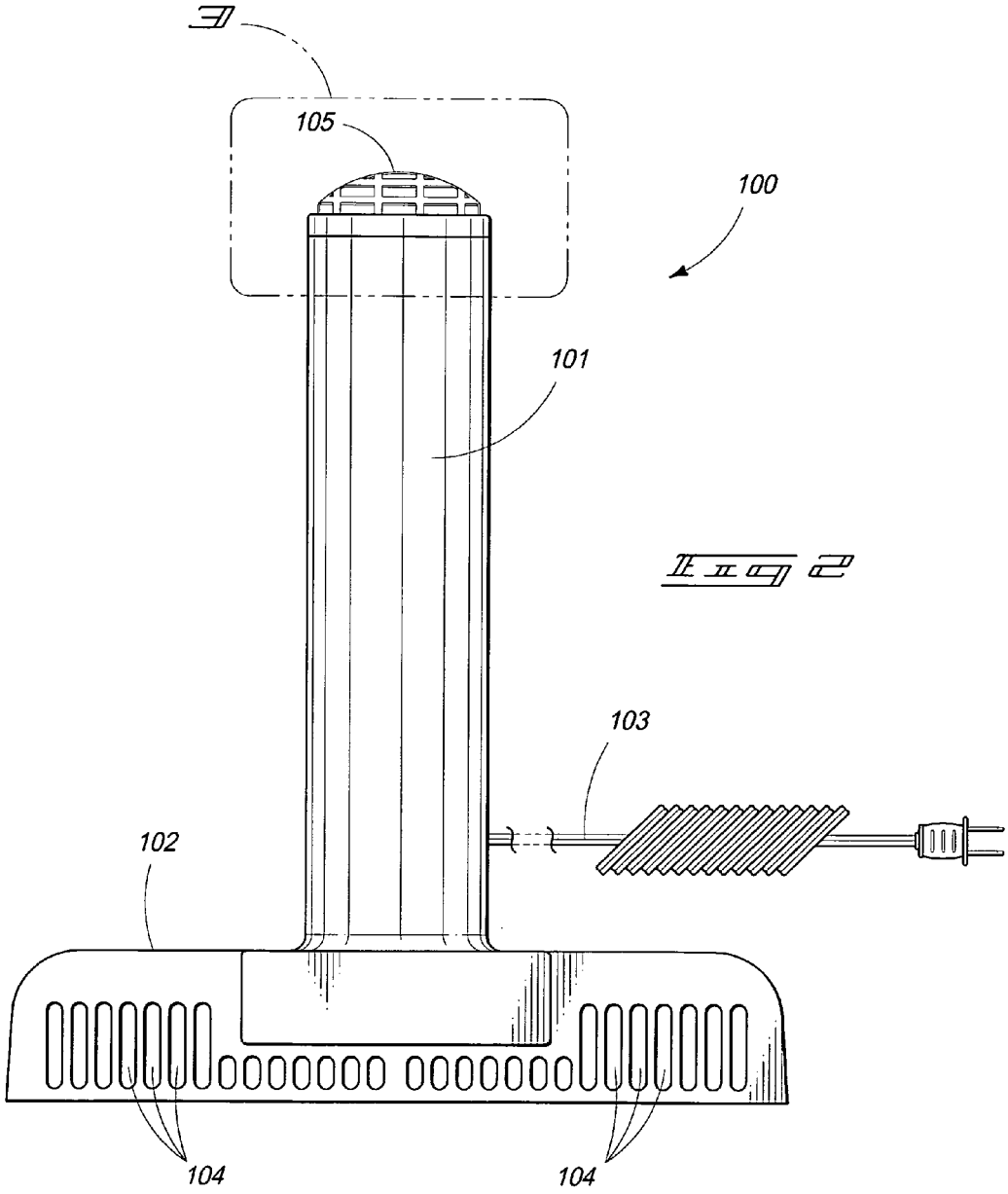
FIG. 2 is a front elevation view of the example of the embodiment of the invention illustrated in FIG. 1.

FIG. 2 is a front elevation view of the example of the embodiment of the invention 100 illustrated in FIG. 1, illustrating air chamber 101, end cap 105, base 102, intake apertures 104 and power cord 103. Figure to further shows, from elevation, the arcuate or uneven nature of the end cap 105 prevent blockage of the exit apertures within and 105.

Figure 3:
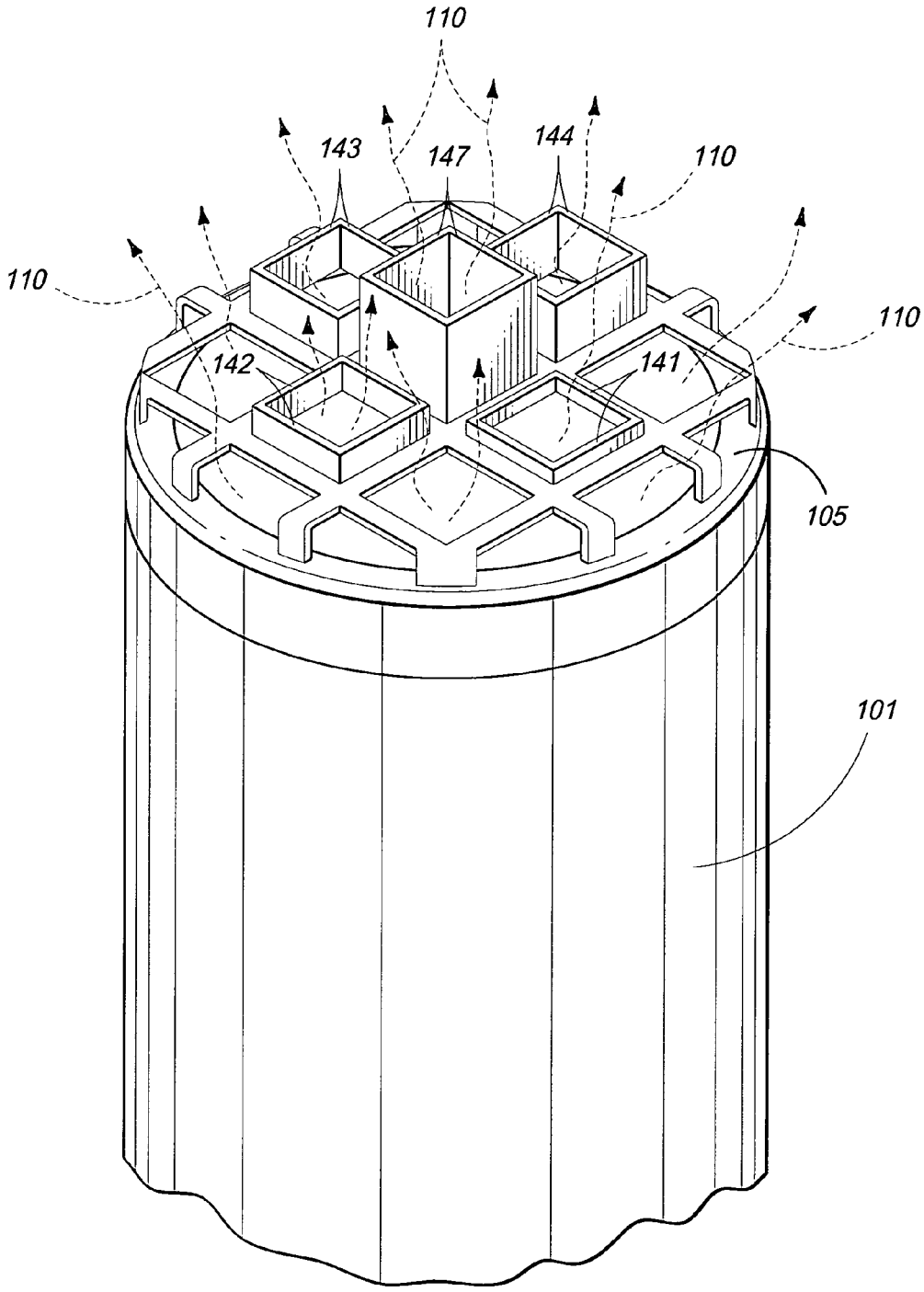
FIG. 3 is Detail 3 from FIG. 2 and illustrates one example of an embodiment of an end cap configuration which may be utilized in practicing embodiments of this invention.

FIG. 3 is Detail 3 from FIG. 2 and illustrates one example of an embodiment of an end cap configuration which may be utilized in practicing embodiments of this invention. FIG. 3 illustrates air chamber 101, end cap 105 and air exiting through exit apertures within the end cap 105. While this invention is not limited to one configuration of aperture outlets through end cap 105, FIG. 3 illustrates one possible configuration which would prevent blockage of airflow through end cap 105. It will be appreciated by those of ordinary skill in the art that there are numerous potential configurations with uneven exit aperture protrusions to prevent blockage of airflow exiting through the end cap 105, with the generally arcuate (from the profile view) raised surfaces being one way.

Figure 4:
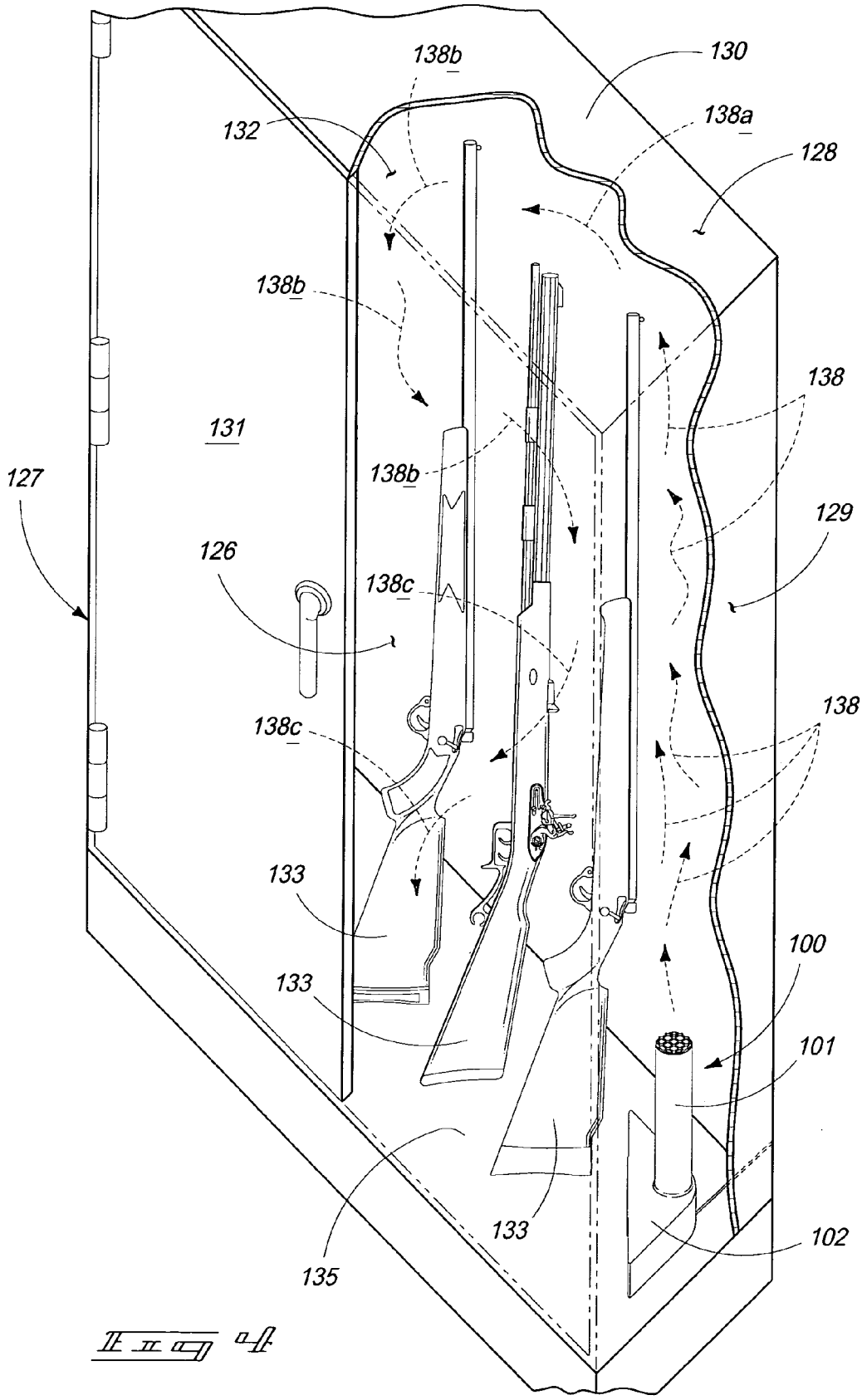
FIG. 4 is a perspective view of enclosure with an example of one embodiment of this invention utilized therein.

FIG. 4 is a perspective view of enclosure 130 with an example of one embodiment of this invention utilized therein. FIG. 4 illustrates dehumidifier 100 generally located within a safe interior 132. The safe is a typical safe with four walls 126, 127, 129 and 131 (also a door in this example), a floor 135 and a top wall 128. The air dehumidifier 100 is preferably (but not necessarily) place on the floor 135 or at a lower portion, and in a corner of the safe. Guns 133 or articles are shown within the interior 132 of the safe or enclosure. The invention is shown with dehumidifier base 102 and air stack 101. Initial warmed air 138 exiting through the air stack 101 rises within the safe interior and when it approaches or reaches the top of the interior, it circulates within and across as representatively indicated by arrows 138*a*. As the warmer air rises within the interior, cooler air moves toward the bottom of the interior and may be drawn into the inlet apertures (not shown in this figure). The air flow of the warmer or heated air 138 exiting the dehumidifier draws cooler air in the inlet apertures in the base, which also helps draw the airflow downwardly as indicated by arrows 138*b* and further by arrows 138*c*.

It will be appreciated from the figures and description above that this invention provides a safe enclosure dehumidifier system which is comprised of: a safe such as illustrated in FIG. 4, the safe including a floor 135, a top wall 128, and four side walls defining a safe interior 132. The locking door in the example in FIG. 4 is also one of the four walls and provides access to the safe interior 132. The dehumidifier 100 is positioned at a lower end within the safe interior (on the floor 135) and includes: a base 102 with air intake apertures (such as shown and described in other figures) configured for receiving circulating air from the lower end within the safe interior and with an interior air flow conduit which delivers air to the air conduit stack 101. The air conduit stack 101 includes an interior air flow conduit configured to receive air flow from the base 102 and includes a lower end 101*b* combined with the base 102. An electrical resistance heater (shown in FIG. 5) mounted within the interior air conduit and configured to heat air within the interior air conduit (as shown and described with respect to FIG. 5).

An end cap 105 is mounted at the top end 101*a* of the air conduit stack 101, the end cap 105 providing air flow apertures to allow heated air 110 flowing upwardly through the interior air conduit to flow into the safe interior. As shown in FIG. 3, the end cap includes raised upper surface portions (such as 141, 142, 143, 144, 147), with some at elevationally higher positions than other upper surface portions, as shown or in other configuration. The different elevational positions and discontinuous outer surface providing a varied upper surface and thereby prevents the inadvertent covering of all the air flow apertures and consequently prevents the air flow through the air stack from being blocked. The heated air 138 in FIG. 4 is released through the air flow apertures in the end cap and combined with air drawn in through the air intake apertures in the base, provides an air circulation and dehumidification within the safe interior.

Figure 5:
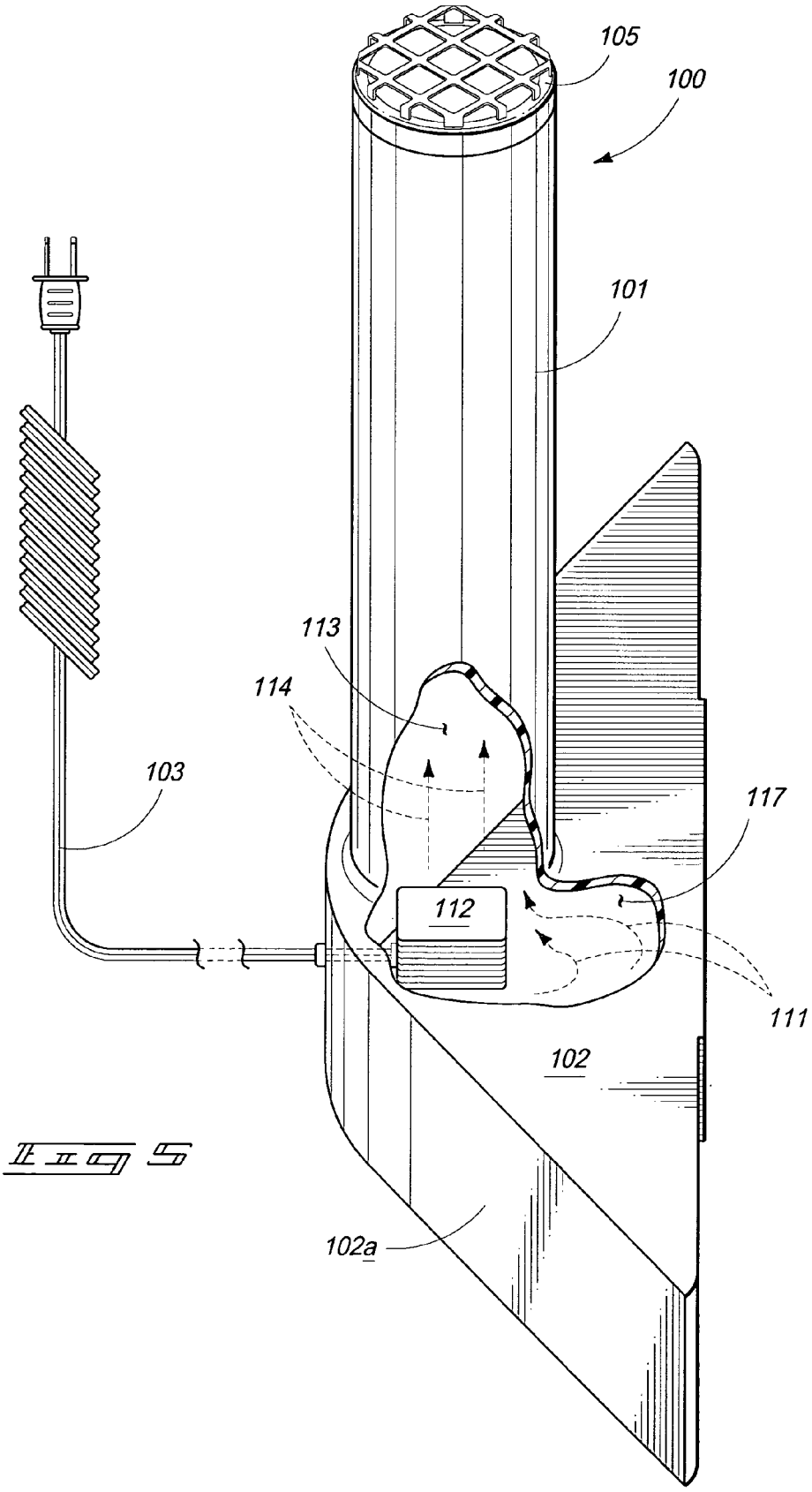
FIG. 5 is a side view of the embodiment of this invention illustrated in FIG. 1.

FIG. 5 is a side view of the embodiment of this invention illustrated in FIG. 1, illustrating dehumidifier base 102, air chamber 101, power cord 103 and base side 102*a*. FIG. 5 also shows air flow conduit 117 within base, air flow conduit 113 within air stack 101, airflow 11 in base and airflow 114 in air stack 101. Electrical resistance heater 112 is also shown within the air flow conduit and provides heat to air flowing within the air conduit.

As will be appreciated by those of reasonable skill in the art, there are numerous embodiments to this invention, and variations of elements and components which may be used, all within the scope of this invention.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A safe enclosure dehumidifier system comprising:

a safe with a floor, a top wall and four side walls defining a safe interior, and with at least one locking door providing access to the safe interior in one of the four walls;

a dehumidifier positioned at a lower end within the safe interior, the dehumidifier including:

a base with one or more air intake apertures configured for receiving circulating air from the lower end within the safe interior and with an interior air flow conduit, the base including a corner portion configured for placement in a corner or the safe interior;

an air conduit stack with a lower end combined with the base and including an interior air flow conduit configured to receive air flow from the base, the air conduit stack combined with the base at the corner portion;

an electrical resistance heater mounted within the interior air conduit and configured to heat air within the interior air conduit;

an end cap mounted at the top end of the air conduit stack, the end cap providing a plurality of air flow apertures to allow heated air flowing upwardly through the interior air conduit to flow into the safe interior, and further comprising raised upper surface portions defining said plurality of flow apertures, said raised upper surface portions being at an elevationally higher position than others of the raised upper surface portions, thereby providing a varied upper surface; and wherein heated air released through the air flow apertures in the end cap combined with air drawn in through the air intake apertures in the base, provide an air circulation and dehumidification within the safe interior.

2. A safe enclosure dehumidifier system as recited in claim 1, and further wherein the air conduit stack is upwardly tapered with a smaller cross section air flow area at a top end that a lower end.

* * * * *